US010246283B2

(12) United States Patent
Gardner et al.

(10) Patent No.: US 10,246,283 B2
(45) Date of Patent: Apr. 2, 2019

(54) VERTICAL WALL WEBBING INSTALLATION METHOD AND SYSTEM

(71) Applicant: Pacific Coast Building Products, Inc., Rancho Cordova, CA (US)

(72) Inventors: Arthur Ralph Gardner, Pleasanton, CA (US); Paul Edwin Boney, Salida, CA (US); Christopher Joseph Bueno, San Leandro, CA (US); Joseph Carlton Moug, Santa Rosa, CA (US); Jose Arturo Bueno, San Lorenzo, CA (US)

(73) Assignee: Pacific Coast Building Products, Inc., Rancho Cordova, CA (US)

( * ) Notice: Subject to any disclaimer, the term of this patent is extended or adjusted under 35 U.S.C. 154(b) by 685 days.

(21) Appl. No.: 14/636,935

(22) Filed: Mar. 3, 2015

(65) Prior Publication Data

US 2016/0257524 A1 Sep. 8, 2016

(51) Int. Cl.
*B65H 16/00* (2006.01)

(52) U.S. Cl.
CPC ... *B65H 16/005* (2013.01); *B65H 2301/3251* (2013.01); *B65H 2301/3253* (2013.01); *B65H 2301/364* (2013.01); *B65H 2301/413226* (2013.01); *B65H 2701/1922* (2013.01)

(58) Field of Classification Search
CPC ..... B65H 16/005; B65H 2701/1922; B65H 2301/413226; B65H 2301/364; B65H 2301/4131; B65H 2301/3251
USPC ..... 242/557
See application file for complete search history.

(56) References Cited

U.S. PATENT DOCUMENTS 2,914,270 A * 11/1959 Parker ..... B65H 49/32 242/390.7
3,395,485 A * 8/1968 Rooklidge ..... A01G 13/025 242/557
4,555,073 A * 11/1985 Barazone ..... E01C 19/522 242/557
5,163,634 A * 11/1992 Moon ..... E04H 17/266 140/123.5

(Continued)

FOREIGN PATENT DOCUMENTS

CN 204280476 * 4/2015

*Primary Examiner* — Michael E Gallion
(74) *Attorney, Agent, or Firm* — Sheppard Mullin Richter & Hampton LLP

(57) ABSTRACT

A system and method of installation for installing a rolled sheet material on a vertical or near-vertical surface are described. Specifically the system and method of installation are useful in the construction industry where heavy rolls of sheet materials must be precisely installed on walls and other vertical surfaces that can be several stories high. The system includes a rolled material spool holder with mounting hardware to allow mounting of the spool holder to a piece of construction equipment along with a spool director, which is also mounted to the piece of movable construction equipment, such as a scissor lift. The method of installation involves positioning the scissor lift along the wall in the desired start location and the desired starting height. The operator affixes the start of the roll to the wall and then drives the scissor lift along the wall, which causes the roll to unwind due to the movement of the scissor lift, while an additional worker affixes the roll to the wall at the desired intervals.

2 Claims, 4 Drawing Sheets

(56) References Cited

U.S. PATENT DOCUMENTS

| | | | | | |
|---|---|---|---|---|---|
| 5,607,282 | A * | 3/1997 | Brannen | B65G 59/00 | 198/463.1 |
| 5,660,353 | A * | 8/1997 | Adams, Jr. | B65H 16/02 | 242/557 |
| 6,042,046 | A * | 3/2000 | Beyer, Sr. | B65H 49/32 | 242/399.1 |
| 6,360,984 | B1 * | 3/2002 | England | B65H 16/02 | 242/557 |
| 6,685,132 | B1 * | 2/2004 | Allen | B65H 49/32 | 242/557 |
| 6,860,471 | B2 * | 3/2005 | Albritton | B65H 49/32 | 140/108 |
| 7,143,971 | B2 * | 12/2006 | Yoder | B65H 16/103 | 242/390 |
| 7,185,839 | B2 * | 3/2007 | Albritton | B65H 49/32 | 242/397 |
| 8,926,305 | B2 * | 1/2015 | Kuchar | B31D 3/002 | 242/580.1 |
| 2003/0080236 | A1 * | 5/2003 | Armstrong | B65H 16/005 | 242/557 |
| 2007/0210202 | A1 * | 9/2007 | Miller | B65H 16/103 | 242/557 |
| 2010/0037540 | A1 * | 2/2010 | Atkins | B26D 1/025 | 52/173.1 |
| 2011/0121125 | A1 * | 5/2011 | Stow | B66D 1/36 | 242/557 |
| 2012/0325956 | A1 * | 12/2012 | Morgan | B65H 75/22 | 242/588.2 |
| 2016/0257524 | A1 * | 9/2016 | Gardner | B65H 16/005 | |

* cited by examiner

VERTICAL WALL WEBBING INSTALLATION METHOD AND SYSTEM

BACKGROUND OF THE INVENTION

1. Field of the Invention

This invention relates to a system for installing rolled sheet material on a wall and methods for installing a rolled construction material. More specifically, this invention relates to a system for installing rolled waterproofing webbing to a vertical or near vertical wall and methods for installing rolled waterproofing webbing to a vertical or near vertical wall.

2. Description of Related Art

Rolled sheet materials, such as textiles, paper, flexible plastics, roofing materials, waterproofing materials, and the like come in rolls where the thin material is generally rolled around an open core. This rolled configuration allows manufacturers to provide materials that cover a large surface area in a compact form as the rolls can contain hundreds of feet of length of material depending on the thickness and weight of the material. Generally, materials that are relatively flat and flexible are good candidates to be offered in rolled configurations.

Rolled sheeting materials are used extensively in construction projects, and contractors must take the rolled material and unroll it into a flat sheet for installation. Most rolled sheeting materials used for construction are heavy and difficult for workers to handle when installing, especially on a vertical surface. In these instances, the rolled material must be kept level or near-level as it is unrolled and installed to maintain a proper overlap of the layer of material installed below, and sags and wrinkles may distract from the performance of the material. Further, as the layers are installed vertically, the workers must move further up the wall and away from the ground, which makes the process more difficult and dangerous. The prior art fails to provide systems and methods of installation to allow easier and safer use of rolled materials, especially in vertical or near-vertical applications.

It is therefore desirable to have a system and method for installation that enables simpler and safer deployment of sheet material from a rolled state into an unrolled and deployed state on a vertical or near vertical-wall.

SUMMARY OF THE INVENTION

The present invention provides for a system and method of installation for installing a rolled sheet material on a vertical or near-vertical surface. Specifically the system and method of installation are useful in the construction industry where heavy rolls of sheet materials must be precisely installed on walls and other vertical surfaces that can be several stories high.

The system includes a rolled material spool holder with mounting hardware to allow mounting of the spool holder to a piece of construction equipment along with a spool director, which is also mounted to the piece of construction equipment. The material spool holder consists of a vertical circular shaft with a rotatable, preferably round base plate near the bottom of the vertical shaft. In use, the vertical circular shaft extends through the round open core of the rolled sheet material and supports the material vertically. The rolled material rests on the base plate, which supports the weight of the roll and also rotates as the rolled material is unwound during installation. The vertical shaft of the spool holder extends through the base plate and is mounted underneath the base plate to a horizontal support element.

The horizontal support element of the rolled material spool holder is connected to an additional vertical support beam, which is spaced apart from the vertical circular shaft due to the length of the horizontal support element. The vertical support beam is connected to a vertical mounting plate by a hinge. The hinge is located on the bottom of the vertical support beam and vertical mounting plate, which allows the vertical support beam and vertical circular shaft to be rotated 90 degrees downward to a horizontal plane. This allows for easier installation of the rolled material onto the vertical shaft of the spool holder, which is in fixed relation to the support beam via the horizontal support element. The vertical support beam additionally includes a threaded bolt extending perpendicularly therefrom which is aligned with a receiving hole in the vertical mounting plate. When the vertical support beam is in its vertical position adjacent to the vertical mounting plate, the threaded bolt extends through the receiving hole in the vertical mounting plate, and the support beam is secured in its vertical orientation via a washer and wing nut.

The vertical mounting plate includes mounting hardware, which allows it to be mounted to a piece of construction equipment. In the preferred embodiment, the spool holder is attached to a piece of construction equipment known as a scissor lift. Because scissor lifts offer forward and backward movement along with vertical movement, attachment to a scissor lift allows the operator to precisely control the height of the roll during installation as well as the unwinding of the roll as the scissor lift moves along beside the wall.

The system also preferably includes a spool director, which consists of a vertical shaft, a horizontal support member and mounting hardware to allow mounting of the spool director to the construction equipment. The function of the spool director is to help control the unwinding of the spool of material and to allow the material to change direction around the corner of the construction equipment if desired. The vertical shaft of the spool director is preferably a narrow steel rod with pins at each end to support a concentric piece of hollow, larger-diameter pipe. In use, the material being unwound contacts the hollow pipe, which is able to rotate freely around the internal steel rod. The steel rod is longer than the hollow external pipe, which allows the horizontal support member to be attached to the top of the steel rod on one end. The other end of the horizontal support member attaches to the construction equipment with the use of mounting hardware.

The method of installation that enables simpler and safer deployment of sheet material from a rolled state into an unrolled and deployed state on a vertical or near-vertical wall incorporates the system described above. In the preferred embodiment, the rolled material spool holder is first mounted to a scissor lift. Next, the vertical support beam and spool holding vertical shaft is rotated down to a horizontal position via the hinge to allow for loading the rolled material onto the holder. Once loaded, the support beam and spool-holding vertical shaft are returned to a vertical orientation and locked in place adjacent to the vertical mounting plate through the use of the threaded bolt and wing nut. A rope attached to the end of the vertical support beam can be used to pull the support beam and spool-holding shaft back to vertical after loading. Once the rolled material is loaded, the scissor lift is positioned along the wall in desired start location and positioned vertically to the desired height. The operator affixes the start of the roll to the wall and then drives the scissor lift along the wall, which causes the roll to unwind due to the movement. In the preferred embodiment, one operator drives the scissor lift, while an additional worker affixes the roll to the wall at the desired intervals. This process continues along the length of the wall. The worker then cuts the roll and raises the scissor lift to the desired height for the next row. This process continues until the wall is covered with the rolled material. If the spool holder is mounted on the end of the scissor lift rather than the side, then the spool director with the rotatable outer pipe would be mounted close to and extending from the corner to allow the rolled material to leave the roll and wrap around the corner. Mounting the spool holder on the end rather than the side of the scissor lift allows the scissor lift to be positioned closer to the wall, which enables the workers to be closer for affixing the rolled material to the wall.

The novel features and construction of the present invention, as well as additional objects thereof, will be understood more fully from the following description when read in connection with the accompanying drawings.

BRIEF DESCRIPTION OF THE DRAWINGS

The improved process of the invention is further described and explained in relation to the following figures of the drawings wherein.

Like reference numerals are used to describe like parts in all figures of the drawings.

DESCRIPTION OF THE PREFERRED EMBODIMENTS

Figure 1:
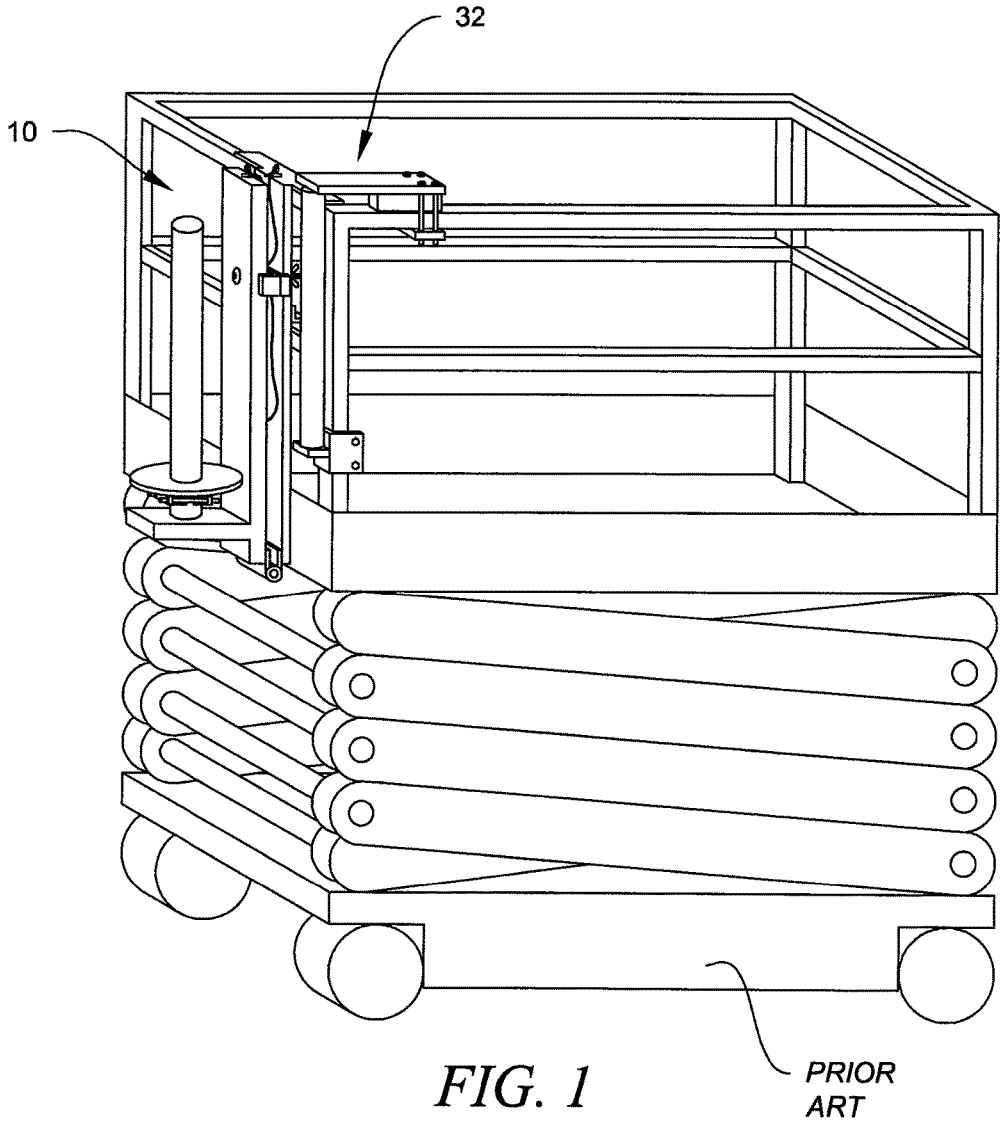
FIG. 1 is an illustration of the system for installing a rolled material on a vertical surface attached to a prior art scissor lift used in construction projects.

Referring to FIG. 1, a prior art scissor lift used in construction projects is shown with the system for installing a rolled material onto a vertical surface attached thereto. In the preferred embodiment, the system comprises material spool holder 10 and spool director 32. Both spool holder 10 and spool director 32 are preferably mounted to a motorized scissor lift, which allows forward and backward movement as well as vertical movement. This provides greater flexibility when using the system to install the rolled material onto a vertical or near vertical surface, especially vertical surfaces that extend several feet above the ground. As shown in FIG. 1, the preferred mounting location for material spool holder 10 is on the end of the scissor lift, which allows the scissor lift to be nearer the wall during installation. When spool holder 10 is mounted on the end of the scissor lift, spool director 32 is mounted near the corner of the scissor lift to direct the material around the corner to the side of the scissor lift where it can be installed on the wall as the scissor lift moves along the wall. Alternatively, spool holder 10 can be directly mounted to the side of the scissor lift, which would obviate the need for spool director 32. In this configuration (not shown), the material would not need to be directed around the corner of the scissor lift before installation on the wall, but the scissor lift would be spaced-apart from the wall at least a distance as wide as spool holder 10, which would be protruding from the side of the scissor lift next to the wall.

Figure 2:
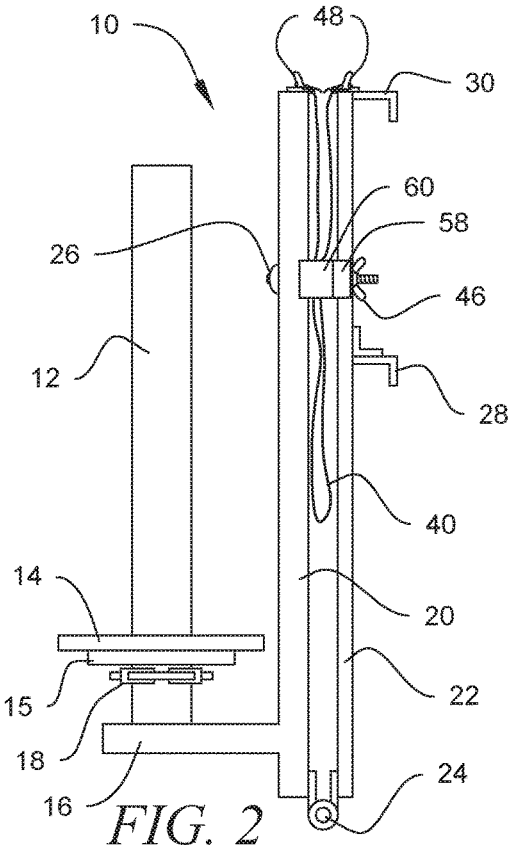
FIG. 2 is a side view of the material spool holder of the present invention.
Figure 3:
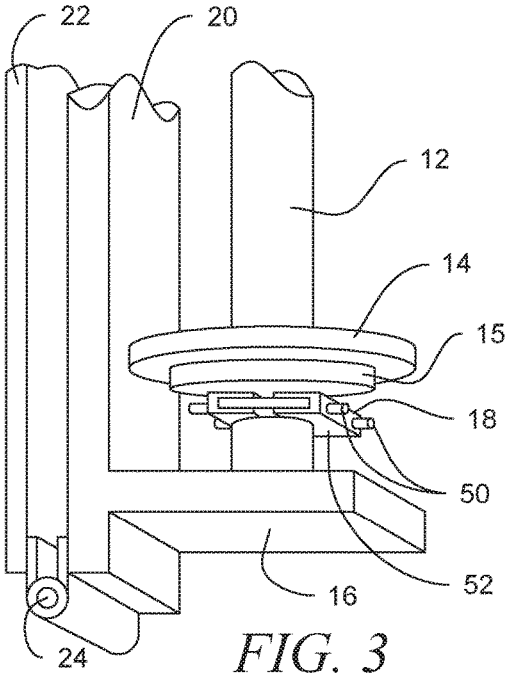
FIG. 3 is a perspective view of the bottom half of the material spool holder of the present invention.

Referring to FIGS. 2 and 3, the preferred embodiment of material spool holder 10 of the present invention is shown. Material spool holder 10 comprises vertical shaft 12, base plate 14, horizontal support element 16, vertical support beam 20 and vertical mounting plate 22. Vertical shaft 12 has a circular cross-section and is sized to fit inside the round open core of a rolled sheet material. The diameter of the round open core of the rolled sheet material must be greater than the diameter of vertical shaft 12 to allow the rolled sheet material to rotate freely around vertical shaft 12, which is rotationally stationary. Vertical shaft 12 extends downward and thru base plate 14 and terminates at horizontal support element 16.

Base plate 14 is preferably circular in shape and rests on smaller plate 15, which preferably is also circular and has a smaller diameter than base plate 14. When the rolled sheet material is installed on material spool holder 10, it rests on base plate 14. Smaller base plate 15 is supported vertically on vertical shaft 12 through the use of support 18. In the preferred embodiment, support 18 is comprised of two pieces 52 that are clamped around vertical shaft 12 with threaded bolts 50. Support 18 is stationary on vertical shaft 12 and provides a supportive base for base plate 15 to rest upon. Support 18 could take several different forms including other bolted on or welded brackets, etc. such that support 18 is rigidly mounted to and stationary on vertical shaft 12. The embodiment with two pieces 52 clamped on vertical shaft 12 with threaded bolts 50 is preferred because it allows base plates 14 and 15 to be raised and lowered along vertical shaft 12 depending on the width of the rolled sheet material that is being installed. Base plates 15 provides more support for base plate 14 and allows for heavier rolls of sheet material to be supported, but alternatively, base plate 14 could directly rest on support 18, if support 18 was sized larger to provide more support. Base plates 14 and 15 are free to rotate in relation to vertical shaft 12, which allows the rolled sheet material to unwind as it is being installed. Base plate 14 preferably has a sufficient diameter to support the full thickness of the roll of rolled sheet material being installed.

Horizontal support element 16 connects vertical shaft 12 to vertical support beam 20, which is mounted on the prior art scissor lift through the use of vertical mounting plate 22. Horizontal support element 16 is sized sufficiently to space vertical shaft 12 apart from vertical support beam 20 to allow for the diameter of base plate 14 to rotate freely without interference from vertical support beam 20. In the preferred embodiment, horizontal support element 16 is rigidly attached via welding to vertical support beam 20. Alternatively, horizontal support element 16 could be releasably mounted on vertical support beam 20 through the use of pins with clips, bolts with nuts or the like. Releasable mounting of horizontal support element 16 would allow for removal of horizontal support element 16 and vertical shaft 12 from spool holder 10 when not in use, which would allow vertical support beam 20 and vertical mounting plate 22 to be left mounted on the prior art scissor lift when spool holder 10 is not in use. Releasable mounting of horizontal support element 16 could also allow for adjustable height mounting of horizontal support element 16 (and consequently base plate 14 and vertical shaft 12), which would give the operator greater flexibility depending on the width of the rolled sheet material that is being installed.

Vertical support beam 20 is approximately parallel with vertical shaft 12, and in the preferred embodiment extends below horizontal support element 16 and above the upper end of vertical shaft 12. Vertical support beam 20 is connected to vertical mounting plate 22 via hinge 24 located at the bottom of vertical support beam 20 and the bottom of vertical mounting plate 22. Hinge 24 allows vertical support beam 20 and vertical shaft 12 to rotate 90 degrees downward to a horizontal plane to allow the rolled sheet material to be installed on the spool holder 10 more easily. This will be discussed more fully with regard to FIG. 5 below. Alternatively, vertical support beam 20 could be directly attached to the prior art scissor lift, wherein vertical mounting plate 22 would be unnecessary. This is a more simple and cost-effective design, but this design does not allow for the hinged lowering of vertical shaft 12 for easier installation of the rolled sheet material onto spool holder 10.

In the preferred embodiment, vertical support beam 20 has threaded bolt 26 extending perpendicularly towards and through a hole in vertical mounting plate 22. Spacers 58 and 60 keep vertical support beam 20 and vertical mounting plate 22 parallel and act as a barrier to prevent over-rotation of vertical support beam towards vertical mounting plate 22. Spacers 58 and 60 serve to ultimately keep vertical shaft 12 vertical, which allows for more uniform unrolling of the rolled sheet material and better installation on vertical surfaces. Vertical support beam 20 is held in place through the use of winged nut 46, which is screwed on threaded bolt 26 when threaded bolt 26 is protruding through the hole in vertical mounting plate 22. Rather than a threaded bolt/wing nut configuration, a steel pin and clip or other similar type configuration could also be used as long as vertical support beam 20 is rigidly held in place against spacers 58 and 60. This connection must provide sufficient support to prevent vertical shaft 12 and base plate 14 from rotation downward due to the weight of the rolled sheet material. Eye bolts 48 are attached to the tops of vertical support beam 20 and vertical mounting plate 22. Rope 40 is connected to each eye bolt to prevent vertical support beam 20 from rotating greater than 90 degrees when hinged downward for rolled sheet material loading and by subsequently pulling the rope, the operator can return vertical support beam 20 to its upright position after loading. This will be discussed more fully with regard to FIG. 5 below. Vertical mounting plate 22 is attached to the prior art scissor lift through the use of mounting hardware 28 and 30. Mounting hardware 28 and 30 could take any form of brackets, clips, bolts, etc. such that vertical mounting plate 22 is rigidly secured to the prior art scissor lift. In the preferred embodiment, mounting hardware 28 and 30 are L-shaped brackets that fit over the square cross-section rails of the scissor lift.

Figure 4:
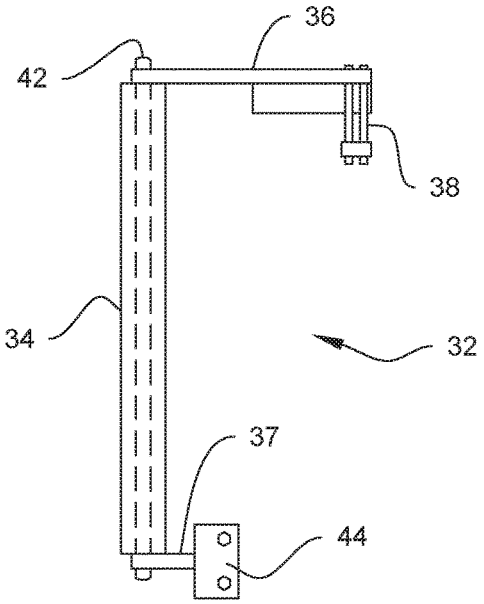
FIG. 4 is a side view of the spool director of the present invention.
Figure 2A:
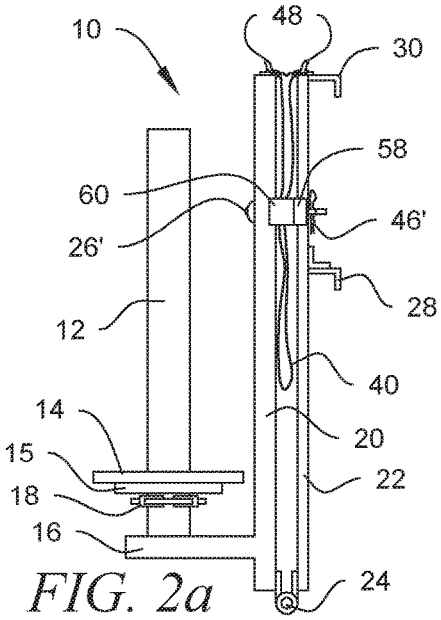

Referring to FIG. 4, spool director 32 is shown. Spool director 32 consists of vertical shaft 42, directing pipe 34, horizontal support members 36, 37 and mounting hardware 38, 44. Vertical shaft 42 is preferably a narrow steel rod that extends between and through upper horizontal support member 36 and lower horizontal support member 37. Vertical shaft 42 is held in place with pins located above upper horizontal support member 36 and below lower horizontal support member 37. Directing pipe 34 is a hollow pipe that has a larger-diameter than vertical shaft 42 and fits between upper horizontal support member 36 and lower horizontal support member 37. Due to directing pipe 34 being aligned concentrically around vertical shaft 42, it is free to rotate. As the rolled sheet material is being unwound during installation, it passes against directing pipe 34. Due to the rotation of directing pipe 34, the material is allowed to move against and around directing pipe 34 more freely. Spool director 32 is attached to the prior art scissor lift through the use of mounting hardware 38 and 44. Mounting hardware 38 and 44 could take any form of brackets, clips, bolts, etc. such that spool director 32 is rigidly secured to the prior art scissor lift. In the preferred embodiment, mounting hardware 38 and 44 comprises brackets that are bolted onto the rails of the scissor lift.

Figure 5:
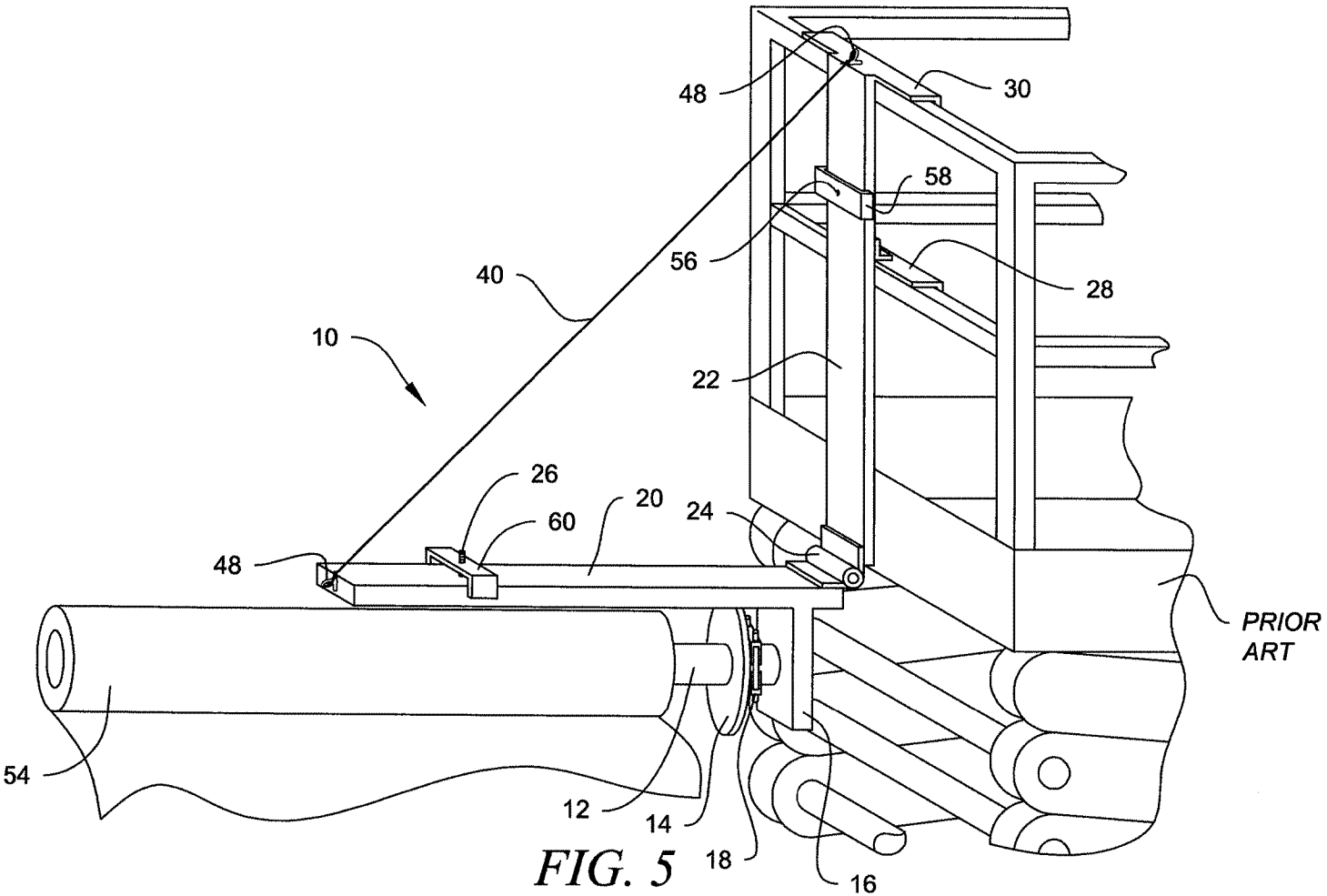
FIG. 5 is a perspective view of the system for installing a rolled material on a vertical surface lowered into its loading position.

Referring to FIG. 5, material spool holder 10 is shown in its loading position in which vertical support beam 20 and vertical shaft 12 have been rotated 90 degrees downward via hinge 24 to a horizontal orientation. Rolled sheet material 54 has been placed on vertical shaft 12, which is in a horizontal orientation in this loading position. Rope 40 is taut and its length has been chosen such that the rotation of vertical support beam 20 is limited to the desired 90 degrees. Alternatively, a chain or strap could be used instead of rope 40. After rolled sheet material 54 has been placed on vertical shaft 12 and pushed against base plate 14, vertical support beam 20 is returned to its vertical position by either the worker pulling rope 40 or by another worker on the ground manually pushing up on rolled sheet material 54. As vertical support beam 20 returns to its vertical position, threaded bolt 26 enters hole 56, which extends through spacer 58 and vertical mounting plate 22, and is secured by wing nut 46 (not shown).

Figure 6:
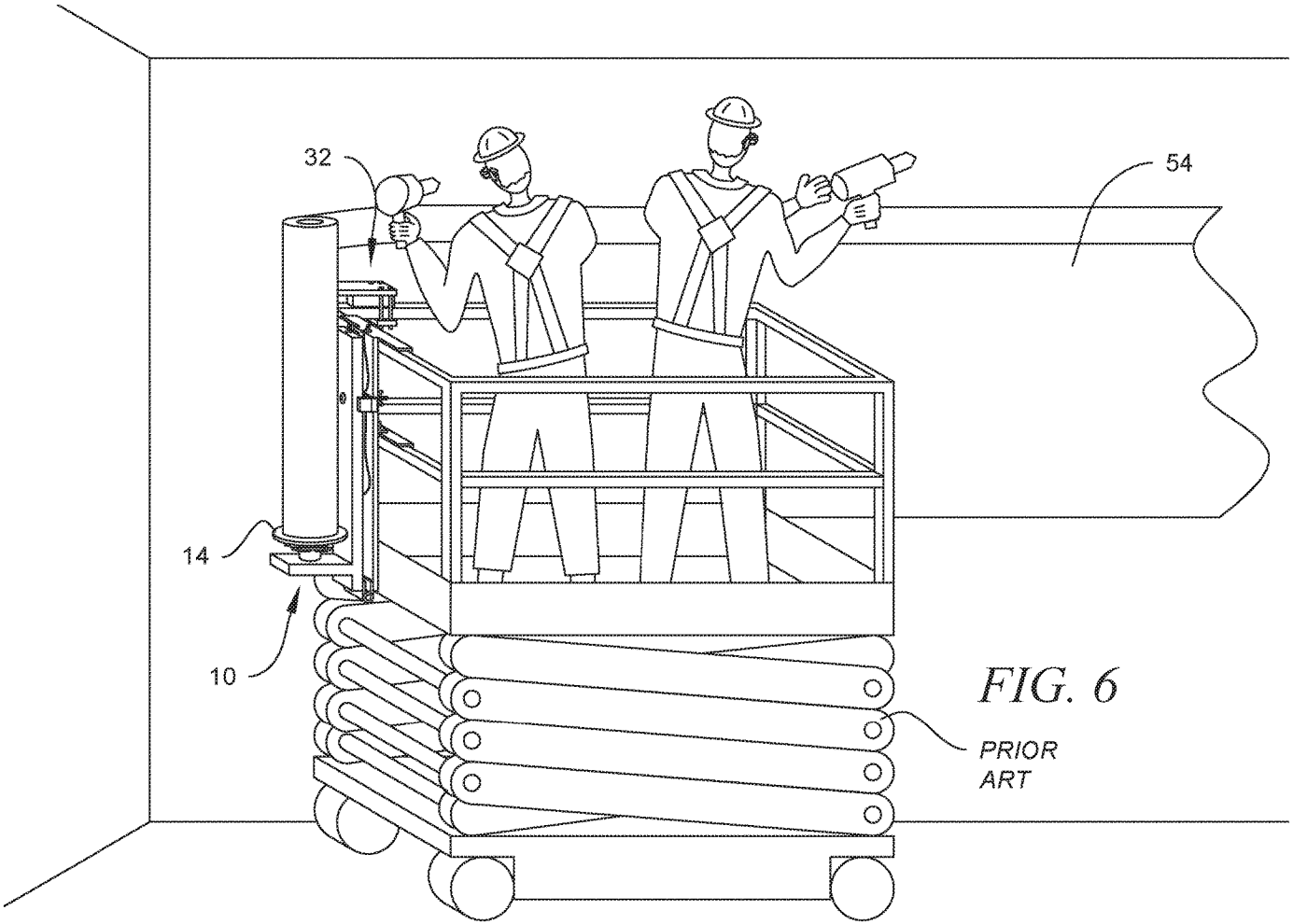
FIG. 6 is a perspective view of the system for installing a rolled material on a vertical surface being used by workers to install a rolled material onto a vertical surface.

Referring to FIG. 6, the method for using the system for installing a rolled material onto a vertical surface is shown. Material spool holder 10 is attached to the end of the prior art scissor lift, and rolled sheet material 54 has been loaded thereon. As rolled sheet material 54 is unwound, it makes contact with spool director 32, which is attached near the corner of the scissor lift. The workers are shown attaching rolled sheet material 54 to a vertical surface or wall. The workers have previously positioned the scissor lift along the wall at the desired start location and have positioned the scissor lift vertically so that rolled sheet material 54 is at the appropriate height on the wall. At the start location, rolled sheet material 54 is unwound, positioned around spool director 32, and then the end is secured to the wall. The scissor lift is driven slowly alongside the wall away from the start position. As the scissor lift moves left along the wall, rolled sheet material 54 unwinds itself through the clockwise rotation of base plate 14 on material spool holder 10. Spool director 32 redirects rolled sheet material around the corner of the scissor lift, which allows the scissor lift to be very near the wall. This allows the workers to easily continue to secure rolled sheet material 54 to the wall as the scissor lift moves along the wall. Once the first row of rolled sheet material 54 is installed, the workers cut material 54 at the desired termination point and the scissor lift is driven back along the wall to the starting position. The scissor lift is then raised vertically to the desired height of the next row of rolled sheet material 54. Rolled sheet material 54 is unwound, positioned around spool director 32, and the end is secured to the wall for the start of the second row. The scissor lift is then driven along the wall at this second row height as the workers secure rolled sheet material 54 to the wall. This process continues up the wall until the desired height has been reached.

Other alterations and modifications of the invention will likewise become apparent to those of ordinary skill in the art upon reading the present disclosure, and it is intended that the scope of the invention disclosed herein be limited only by the broadest interpretation of the appended claims to which the inventors are legally entitled.

The invention claimed is:

1. A system for installing rolled sheet material on a wall comprising:

a material spool holder mounted to a piece of movable construction equipment comprising a vertical shaft sized to fit within an open core of a roll of sheet material, a rotatable base to support the roll of sheet material mounted on the vertical shaft, and a vertical mounting plate mounted to the piece of movable construction equipment that is connected to a vertical support beam with a hinge and a releasable attachment mechanism spaced apart from the hinge;

a horizontal support beam;

wherein the horizontal support beam extends between and connects the vertical shaft and vertical support beam, and further comprising a rotation limiting device wherein the rotation limiting device is a rope that limits an amount of downward rotation of the vertical support beam around the hinge after the releasable attachment mechanism is released.

2. A system for installing rolled sheet material on a wall comprising:

a material spool holder mounted to a piece of movable construction equipment comprising a vertical shaft sized to fit within an open core of a roll of sheet material, a rotatable base to support the roll of sheet material mounted on the vertical shaft, and a vertical mounting plate mounted to the piece of movable construction equipment that is connected to a vertical support beam with a hinge and a releasable attachment mechanism spaced apart from the hinge;

a horizontal support beam;

wherein the horizontal support beam extends between and connects the vertical shaft and vertical support beam, and further comprising a rotation limiting device wherein the rotation limiting device is a chain that limits an amount of downward rotation of the vertical support beam around the hinge after the releasable attachment mechanism is released.

* * * * *